United States Patent [19]

Bouffard

[11] 4,127,346

[45] Nov. 28, 1978

[54] UNIVERSAL TRAFFIC CONTROL MARKER

[76] Inventor: Lloyd J. Bouffard, 100 Oxford Dr., Apt. 704, Monroeville, Pa. 15146

[21] Appl. No.: 683,304

[22] Filed: May 5, 1976

Related U.S. Application Data

[63] Continuation of Ser. No. 564,849, Apr. 3, 1975, abandoned.

[51] Int. Cl.[2] ..... E01F 9/04

[52] U.S. Cl. ..... 404/15

[58] Field of Search ..... 404/15, 16, 9; 350/97; 116/63 R

[56] References Cited

U.S. PATENT DOCUMENTS

| | | | |
|---|---|---|---|
| 1,647,861 | 11/1927 | Furey | 404/15 |
| 1,661,870 | 3/1928 | Baldwin | 404/9 |
| 1,703,227 | 2/1929 | Dickgiesser | 404/9 |
| 1,709,455 | 4/1929 | Baldwin | 404/9 |
| 1,764,073 | 6/1930 | Furey | 404/15 |
| 2,142,803 | 1/1939 | Robertson | 404/16 |
| 2,242,619 | 5/1941 | Richardson | 404/16 |
| 2,635,513 | 4/1953 | Batterson | 404/15 |
| 2,699,982 | 1/1955 | Batterson | 404/15 |

*Primary Examiner*—Nile C. Byers

*Attorney, Agent, or Firm*—Robert D. Yeager

[57] ABSTRACT

A traffic control marker for use with an asphaltic pavement including a rigid plate having a top indicating surface and a bottom surface adapted for contact with the asphaltic pavement and a continuous rigid flange which depends from the peripheral portion of the rigid plate. The continuous rigid flange is adapted for embedment in the asphaltic pavement to a depth at which the top indicating surface of the rigid plate is flush with the top surface of the surrounding asphaltic pavement. The rigid plate is provided with vent holes to assure uniform contact between the bottom of the rigid plate and the asphaltic pavement when the traffic control marker is installed in place. In the preferred form, the continuous rigid flange depends from the rigid plate at an angle of about 90° to the plane of the rigid plate, but may depend at other angles if greater gripping action of the continuous rigid flange is desired. The continuous rigid flange may include a plurality of notches formed in its free end in order to assure greater gripping action and ease of installation, or to conserve construction material. The disclosed traffic control marker is normally fabricated from a corrosion resistant metal such as aluminum or stainless steel.

13 Claims, 5 Drawing Figures

UNIVERSAL TRAFFIC CONTROL MARKER

This is a continuation of application Ser. No. 564,849, filed Apr. 3, 1975, now abandoned.

BACKGROUND OF THE INVENTION

1. Field of the Invention

This invention relates to a traffic control marker; more particularly, to a highly visible and permanent traffic control marker adapted for use with asphaltic pavements.

2. Description of the Prior Art

The most widely used traffic control marker is the painted line. Among the reasons for the continued, almost exclusive use of the painted line as a traffic marker are: relative economy, ease of application, lack of physical interference with pedestrian or vehicular traffic when applied to the pavement surface, and failure of many suggested substitutes to live up to their claimed advantages over the painted line. The use of painted lines, however, involves serious disadvantages, many of which were recognized in the prior art as early as 1925. U.S. Pat. Nos. 1,606,825, 1,728,275 and 1,966,318, for example, note that painted lines involve considerable expense and are but a temporary expedient on heavily traveled streets. While painted lines are more economical than other proposed traffic control markers, nevertheless frequent repainting, as is often required where traffic is heavy, does involve considerable expense and promises to become more expensive because of the rising cost of paint, labor and application machinery.

The very nature of the painting process aggravates these disadvantages. For example, heavily traveled areas must be painted at off-peak hours thereby generating expensive overtime labor costs. In addition, opening the newly painted pavement in response to traffic pressures in heavily traveled areas before the paint is fully set hastens the wearing process from the beginning.

Another disadvantage manifests itself when the painted line is viewed from a safety standpoint. By nature, the visibility of a painted line is greatest when first applied and decreases steadily until repainting is required. As a result, traffic is always exposed to an inadequate marker for a portion of the painting-repainting time cycle.

Prior art devices for overcoming the disadvantages of the painted line have been directed primarily to achieving near permanency of the marker. That is, the prior art sought permanency sufficient to provide that any increased cost of the marker over that of the painted line would be more than offset by saving the cost of repaintings over the life of the highway surface. To that end, many prior art devices are compared of various configurations of metal or similar durable material which are embedded in the pavement surface by various methods; U.S. Pat. Nos. 1,606,825; 1,678,215; 2,127,233; and 1,728,275. U.S. Pat. No. 1,966,318 discloses a traffic marker composed of a thin ribbon of aluminum foil fastened to the pavement by adhesive means. This thin ribbon of foil is in reality little more than a rolled-up painted line glued to the pavement. As a result it suffers many of the same disadvantages as the painted line. While each of these devices does achieve some permanency, the savings achieved in avoiding the cost of repaintings has not been sufficient to offset the cost of manufacturing and, particularly, installing such permanent markers.

It is noted that the devices disclosed in U.S. Pat. Nos. 1,678,215; 1,728,275; and 2,127,233 show undersurface configurations which are relatively complex. Such devices would, because of that complexity, be expensive to manufacture and install. In addition, installation would be time-consuming, resulting in prolonged disruption of traffic, required maintenance of traffic detours, and increased labor costs. It is further noted that none of the prior devices are adapted for economical installation in existing pavement and particularly so with regard to new or existing asphaltic pavement.

In addition, such prior devices are particularly unsuited for use with asphaltic pavements because of the flexible character of such pavements. Asphaltic pavements tend to soften when heated by the sun and as a result are continually kneaded in all directions by passing vehicular traffic. Because of their rigid installation, the above prior art devices cannot adapt to this constant kneading action of the asphaltic surface and will, in time, become exposed in whole or in part so as to project above the surface thereby posing a safety hazard to both vehicular and pedestrian traffic. While the device described in U.S. Pat. No. 1,606,825 is claimed to be suited for use with asphaltic surfaces, it is of a different construction and teaches away from the present invention.

SUMMARY OF THE INVENTION

The present invention overcomes all the disadvantages of the painted line and at the same time provides all the advantages such as relative economy, ease of installation, and lack of physical interference with vehicular and pedestrian traffic when used with asphaltic pavements.

In addition to overcoming the disadvantages of the painted line, the present invention overcomes those of prior art devices by providing both for permanency and continuous high visibility in a configuration which lends itself to economical manufacture and installation. In particular, the present invention provides for a rigid traffic control marker adapted for "floating" embedment in an asphaltic pavement whereby the marker will move as the asphaltic surface moves and yet remain flush with the top surface of the asphaltic pavement and thus highly visible at all times. The traffic control marker of the present invention is configured to achieve good contact with an asphaltic surface so that the marker cannot be disturbed or dislodged by freezing and thawing action or by the characteristic kneading action of asphaltic surfaces.

The present invention provides a highly visible and permanent traffic control marker for use with an asphaltic pavement comprising: a rigid plate having an upper indicating surface and a bottom surface which is in substantially uniform contact with the asphaltic pavement when the traffic control marker is in place; and a continuous rigid flange depending from the peripheral portion of the rigid plate and adapted for embedment in the asphaltic pavement to a depth at which the top indicating surface of the rigid plate is flush with the top surface of the surrounding asphaltic pavement. The rigid plate is circular in the preferred form but other shapes may be used if desired or convenient. The disclosed traffic control marker also provides at least one bore which extends through the rigid plate and is adapted to vent gas which may become trapped between the plate and the asphaltic pavement during installation. In the preferred form of the present invention, the continuous rigid flange depends from the rigid plate at its periphery, but it is contemplated that the flange may depend from the peripheral portion of the plate without departing from the invention. Also in the preferred form, the continuous rigid flange depends from the rigid plate at an angle of about 90° to the plane of the plate so as to facilitate manufacture and installation, although other angular relationships are contemplated by the invention. The continuous rigid flange is preferably integral with and composed of the same material as the rigid plate so as to facilitate economical manufacture as by casting, molding or stamping. The continuous rigid flange is preferably continuous not only where it depends from the rigid plate but also about its free end. Such a configuration contributes to the rigidity of the marker as a whole, simplifies manufacture and provides for uniform gripping action once the marker is embedded in the asphaltic pavement. However, it is contemplated that the free end of the continuous rigid flange may include a plurality of notches which may be configured so as to facilitate installation, assure greater gripping action or provide for conservation of construction material. The disclosed traffic control marker is preferably fabricated from a corrosion-resistant metal such as aluminum or stainless steel. The present invention further discloses a method of installing the traffic control marker in the asphaltic pavement so that the top indicating surface of the rigid plate is flush with the top surface thereof and the bottom surface of the plate is in uniform contact with the asphaltic pavement.

Other details, objects and advantages of the invention will become apparent from a consideration of the following description taken with the accompanying drawings.

DESCRIPTION OF THE PREFERRED EMBODIMENT

Figure 1:
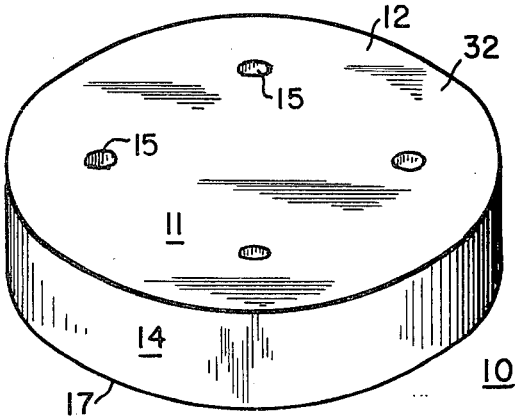
FIG. 1 is a perspective view of the invention as it appears before installation in an asphaltic surface.
Figure 2:
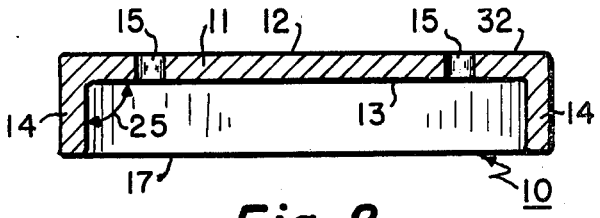
FIG. 2 is a cross-sectional view of the invention taken along a diameter.
Figure 3:
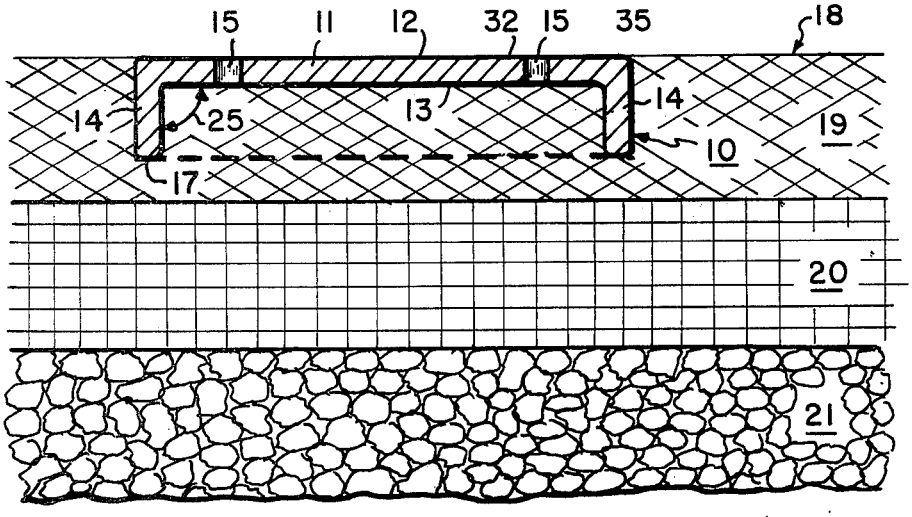
FIG. 3 is a cross-sectional view of the invention similar to FIG. 2, as it appears when installed in an asphaltic surface.

Referring to the drawings and particularly to FIGS. 1–3, there is shown a traffic control marker 10 which includes a rigid plate 11 having a top indicating surface 12 and a bottom surface 13. Plate 11 preferably is formed of a corrosion-resistant metal such as aluminum or stainless steel but may be composed of any sufficiently rigid and durable material. The shape of plate 11 may be varied as desired or as is convenient but is preferably circular as shown in the drawings, so as to facilitate manufacture and assure flexibility in arranging patterns for particular traffic or pedestrian conditions. The size of plate 11 also may be varied as desired or as is convenient, but is preferably dimensioned between four and ten inches in diameter for most traffic control marker applications. Likewise, the thickness of plate 11 may be varied but is preferably about three-eighth inches. In the preferred form, rigid plate 11 includes one or more small diameter bores 15 extending therethrough to vent any gas trapped between the bottom surface 13 of plate 11 and the asphaltic pavement beneath during installation.

Figure 5:
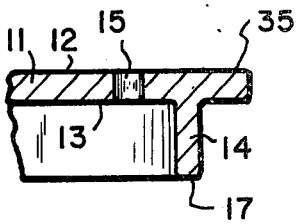
FIG. 5 is a partial cross-sectional view taken along a diameter of a further embodiment of the invention.

The disclosed traffic control marker further includes a continuous rigid flange 14 which depends from the peripheral portion 32 of rigid plate 11. Continuous rigid flange 14 has a free end 17 which is adapted for embedment in asphaltic pavement 18 so that marker 10 is securely gripped therein. In the preferred form shown in FIG. 1, rigid flange 14 depends from the periphery 32 of plate 11, but it is contemplated that rigid flange 14 may depend from any point near the periphery of plate 11 without departing from the invention. In such a case, a peripheral portion 35 of rigid plate 11 would extend a short distance beyond rigid flange 14 as shown in FIG. 5. Likewise, in the preferred form, continuous rigid flange 14 is integral with and composed of the same materials as rigid plate 11. It is apparent that forming rigid flange 14 integral with plate 11 assures economical manufacture as by casting, molding, stamping or the like. As shown in FIGS. 2 and 3, continuous rigid flange 14 depends from rigid plate 11 at an angle 25. In the preferred form, angle 25 is about 90° so as to facilitate installation of marker 10 in an asphaltic pavement in the manner to be more fully described herein. It is understood, however, that angle 25 may be more or less than 90° so as to increase the gripping action of continuous rigid flange 14 once marker 10 is installed in the asphaltic pavement.

The thickness of continuous rigid flange 14, like that of rigid plate 11, may be varied but is preferably about three-eighth inches. The preferred vertical distance between the top indicating surface 12 of rigid plate 11 and the free end 17 of continuous rigid flange 14 is about one inch, but, like other dimensions, may be varied as desired keeping in mind the described vertical distance should be less than the thickness of the upper, fine textured layer of the asphalt pavement into which the invention is embedded. It is noted that the prior art devices provide no guidance as to an appropriate depth of penetration into an asphaltic surface which will assure adequate gripping action, economical installation and flushness of the mark with the asphaltic pavement. It will be readily appreciated that any penetration of such devices into the coarse textured asphalt binder underlying the upper layer, or even beyond into the pavement base would involve considerable effort and expense, especially since certain of such devices incorporate auxiliary anchor bars and the like. The present invention, however, neatly avoids such problems by being of a design which requires that the invention penetrate only the upper surface layer 19 of the asphaltic pavement.

In the preferred embodiment of the present invention as shown in FIGS. 1–3, the width of flange 14 is uniform. This configuration simplifies manufacture and provides for uniform gripping around the periphery of plate 11. The latter feature prevents any peripheral portion of plate 11 from rising above or sinking below the surrounding asphaltic surface as would be possible with a flexible marker or with a marker having a non-continuous flange.

Figure 4:
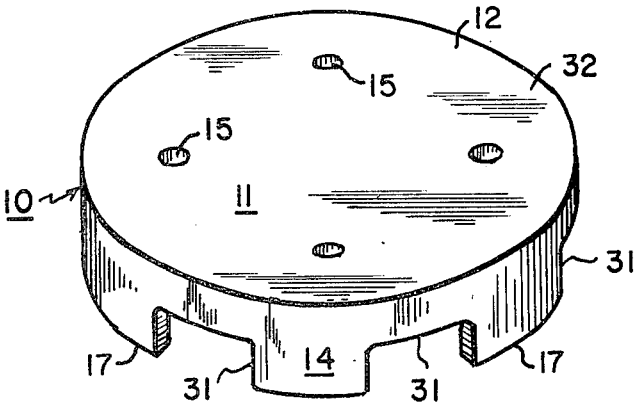
FIG. 4 is a perspective view of another embodiment of the invention as it appears before installation in an asphaltic surface.

Alternate embodiments of the present invention, shown in FIG. 4, provide for a plurality of notches 31 in the free end 17 of rigid flange 14, as shown in FIG. 4. Notches 31 may be used to facilitate installation of disclosed marker 10 to increase overall gripping action of rigid flange 14 by providing increased edge surface area, or to conserve construction material in the manufacture of marker 10. The size, shape and spacing of notches 31 may be varied as is suitable to fit their purpose; in keeping with the discussion above concerning the desirability of uniform gripping action, however, it is preferred that notches 31 be uniform and symmetrically arranged.

The method for installing the present invention in an asphaltic pavement will now be described by reference to FIG. 3 which illustrates the components of a typical asphalt pavement. Pavement 18 includes a fine texture asphalt pavement top layer 19, a coarse texture asphalt binder middle layer 20 and a pavement base lower layer 21, which may be composed of any suitable material such as crushed stone, slag, concrete, brick and the like.

Methods of Installation

In the case of installation in a newly-laid asphalt pavement, i.e. immediately after the finely textured top layer 19 is laid and is at a temperature of 150° F. or above, marker 10 is first heated to a temperature of 500° F. in a portable oven or other convenient source of heat, placed in position on top of asphaltic pavement 18 and then tamped or rolled into the finely textured top layer 19 of the asphaltic pavement 18 until the top indicating surface 12 of rigid plate 11 is flush or level with the top surface of asphaltic pavement 18 as shown in FIG. 3. If the surface temperature of the newly laid asphaltic pavement 18 cools below 150° F. before heated marker 10 can be positioned and tamped, a portable heater, such as an infrared heater commonly used to reheat asphalt joints, must be passed over the area where the marker 10 is to be installed and the asphaltic pavement 18 heated to a temperature in the range of 225° to 325° F., preferably to about 250° F. Then heated marker 10 can be tamped or rolled in pavement 18 as just described.

In the case of installation in a newly-laid asphalt pavement at a time after the pavement is laid, the asphaltic pavement 18 must be heated to 250° F. This may be accomplished by using a portable heater as described above. After asphaltic pavement 18 is heated to 250° F., it may be desirable to use a forming plunger, which is configured to match the continuous rigid flange 14 configuration of marker 10. The forming plunger is used to make a depression in asphaltic pavement 18. Marker 10, heated to 500° F. as described above, is then positioned on asphaltic pavement 18 over the depression made by the forming plunger and tamped or rolled into asphaltic pavement 18 as shown before in FIG. 3.

In the case of installation in a newly-laid asphalt pavement in which the top layer 19 is of a coarse type, exemplified by an aggregate content of which up to 20% is retained on a three-eighth inch screen, but 100% is passed by a three-fourth inch screen, it is desirable to use a forming plunger in the manner as described above even if the surface temperature of the newly-laid asphalt surface 18 has not cooled below 150° F. If the asphalt surface 18 cools below 150° F. it must be heated to 250° F. by a portable heater, such as an infrared heater as described above, before the forming plunger is used. Marker 10, heated to 500° F. as described above, is then positioned on asphaltic pavement 18 over the depression made by the forming plunger and tamped or rolled into asphaltic pavement 18 as shown before in FIG. 3.

Finally, in the case of installation in an existing asphalt pavement, marker 10 is first heated in a suitable heater to 500° F. as described above. Next a depression which conforms to the flange configuration of marker 10 is made in asphaltic pavement 18 with a drill similar to a core drill. Heated marker 10 is then positioned over the depression and tamped and rolled into asphaltic pavement 18 as described above and shown in FIG. 3. It may be desirable to heat asphalt pavement 18 to 250° F. with an infrared heater as described above before proceeding with the last step.

It is to be noted that in all cases, marker 10 is heated to 500° F. before proceeding with installation as described above. This procedure of preheating marker 10 has several important advantages. The first results from the fact that metals expand when heated and contract when cooled. Since marker 10 is installed in the heated and thus expanded condition, it will contract as it cools after installation. As a result of this contraction, marker 10 will become tightly clinched in the asphaltic surface.

Other advantages result from the fact that the asphaltic pavement into which preheated marker 10 is installed will absorb some of the marker's heat. As a result, the asphaltic pavement will soften thereby decreasing resistance to penetration of marker 10 during the tamping or rolling portion of the installation. In addition, this absorbed heat will set free some liquid asphalt. As marker 10 is then tamped or rolled into the asphaltic pavement to the proper depth, this liquid asphalt will be forced tightly against surfaces 13, 14 and 17 and up through small bores 15 in rigid plate 11 to form a permanent water-tight and moisture-proof seal.

What is claimed is:

1. A traffic control marker, for installation in a multilayer pavement having a fine textured upper asphalt layer, comprising:

(a) a rigid plate having a smooth flat top indicating surface and a flat bottom surface, having no cutouts therein and no protrusions therefrom, adapted for contact with the fine textured upper asphalt layer;

(b) a continuous rigid flange of uniform depth having smooth sides depending from the peripheral portion of said rigid plate at substantially a right angle, having a depth less than the thickness of the fine textured upper asphalt layer, and adapted for embedment into the fine textured asphalt layer to a depth at which said smooth flat top indicating surface of said rigid plate is flush with the top surface of the surrounding pavement to hold the traffic control marker in place; and, (c) at least one relatively small bore extending through said rigid plate for venting gas trapped when the traffic control marker is embedded in the fine textured asphalt layer.

2. A traffic control marker as recited in claim 1 wherein said rigid plate is circular.

3. A traffic control marker as recited in claim 1 wherein:

said rigid plate is circular;

said at least one relatively small bore extending therethrough through said rigid plate, for venting gas trapped between said bottom surface of said rigid plate and said asphaltic pavement when said marker is embedded in said pavement, is circular and of a relatively small diameter.

4. A traffic control marker as recited in claim 1 wherein said continuous rigid flange depending from said rigid plate at an angle of about 90° is of a uniform thickness.

5. A traffic control marker as recited in claim 1 wherein said continuous rigid flange is annular and has a uniform thickness;

said rigid plate is flat and of the same thickness as said continuous rigid flange; and, said continuous rigid flange is of a uniform depth and defines an annular surface at the free end thereof.

6. A method of installing a road marker having a flat indicating surface, with a continuous depending rigid flange of uniform depth, having at least one vent bore formed therethrough, in an upper fine textured asphaltic surface comprising the steps of:

(a) heating the upper fine textured asphaltic surface above 150° F. with an infrared heater;

(b) heating the road marker above 400° F.;

(c) positioning the road marker with the indicating surface upward on the heated asphaltic surface;

(d) tamping or rolling the hot road marker into the heated asphaltic surface to a depth where the top indicating surface is flush with the surrounding asphaltic surface and asphalt liquefied by the hot marker is forced into the vent bore and around the embedded depending flange to form a water tight seal whereby the road marker will move as the asphaltic surface moves and yet remain flush with the top surface of the surrounding asphaltic surface.

7. A method of installing a road marker as claimed in claim 6 comprising the additional steps of:

making a depression in the heated fine textured upper asphalt surface with a forming plunger, which is configured to match the continuous rigid flange; and positioning the hot road marker over the depression made by the forming plunger before tamping or rolling the hot road marker into the heated fine textured upper asphalt surface.

8. A method of marking a pavement having a fine textured upper asphalt layer comprising the steps of:

(a) determining the thickness of the fine textured upper asphalt layer;

(b) selecting a road marker having a flat rigid portion with only a vent formed therethrough having a continuous rigid flange depending at substantially 90° therefrom whose depth is less than the thickness of the fine textured upper asphalt layer;

(c) heating the fine textured upper asphalt layer above 150° F.;

(d) heating the selected road marker to around 500° F.;

(e) placing the hot road marker on the heated fine textured upper asphalt layer with the flange down; and (f) tamping and rolling the hot road marker into the fine textured upper asphalt layer to a depth where the top of the flat rigid portion is flush with the surrounding asphalt layer pavement and liquefied asphalt is forced into the vent and around the continuous rigid flange to form a permanent water tight seal with the selected marker and the entire marker is wholly contained within the fine textured upper asphalt layer allowing for floating movement of the marker as the top fine textured asphalt layer moves under the kneading action of vehicular traffic yet remaining flush with the top surface at all times.

9. A method of marking a pavement as claimed in claim 8 comprising:

forming a depression in the heated fine textured upper asphalt layer, conforming to the flange configuration, for receiving the flange when the selected hot road marker is placed on the upper heated asphalt layer.

10. A method of marking a pavement as claimed in claim 9 wherein the depression in the upper fine textured asphalt layer is formed with a core drill.

11. A method of marking a pavement as claimed in claim 9 wherein the depression in the upper fine textured asphalt layer is formed with a forming plunger.

12. A method of marking a pavement having an upper asphalt layer comprising the steps of:

(a) determining the thickness of the upper asphalt layer;

(b) selecting a road marker having a flat rigid portion with only a vent formed therethrough having a continuous uniform depth rigid flange depending at substantially 90° therefrom whose depth is less than the thickness of the upper asphalt layer;

(c) forming a depression in the upper asphalt layer conforming substantially to the flange configuration, by using a core drill, for receiving the hot marker;

(d) heating the selected road marker to around 500° F.;

(e) placing the hot road marker on the heated asphalt layer with the flange engaging the formed depression; and (f) forcing the hot road marker into the asphalt to a depth where the top of the flat rigid portion is flush with the surrounding pavement and asphalt liquefied by the hot marker is forced into the vent and around the continuous rigid flange to form a permanent water tight seal with the selected marker.

13. A method of marking a pavement as claimed in claim 12 comprising the additional step of:

heating the upper asphalt layer after the depression is formed and before the heated marker is placed on the asphalt layer to a temperature around 250° F.

* * * * *